US005154605A

United States Patent [19]

Suey

[11] Patent Number: 5,154,605

[45] Date of Patent: Oct. 13, 1992

[54] REFRACTORY TILE SECTION FOR REHEATING FURNACES

[76] Inventor: Paul V. Suey, R.D. 1, Ridge Road, Sugar Loaf Hill, Natrona Heights, Pa. 15065

[21] Appl. No.: 720,926

[22] Filed: Jun. 25, 1991

[51] Int. Cl.[5] ..... F27D 3/02

[52] U.S. Cl. ..... 432/234; 52/506; 138/158

[58] Field of Search ..... 432/234; 52/506; 138/147, 158, 160, 161

[56] References Cited

U.S. PATENT DOCUMENTS

| | | | |
|---|---|---|---|
| 1,126,351 | 1/1915 | Beabes | 138/158 |
| 2,160,009 | 5/1939 | Walker | 138/158 X |
| 2,650,180 | 8/1953 | Walker | 138/158 X |
| 3,820,947 | 6/1974 | Boto et al. | 432/234 |
| 3,914,100 | 10/1975 | Guskea | 432/234 |
| 3,934,615 | 1/1976 | Lukomskyj et al. | 138/158 X |
| 4,070,151 | 1/1978 | Suey | 432/234 |
| 4,330,266 | 5/1982 | Suey | 432/234 |
| 4,424,027 | 1/1984 | Suey | 432/234 |

FOREIGN PATENT DOCUMENTS

| | | | |
|---|---|---|---|
| 895490 | 5/1962 | United Kingdom | 138/158 |

*Primary Examiner*—Stephen M. Hepperle
*Attorney, Agent, or Firm*—Armstrong & Kubovcik

[57] ABSTRACT

Refractory tile sections for insulating a pipe, such as a water-cooled pipe, have a pair of refractory tiles with concave faces and outwardly extending flanges. The refractory tiles are placed about the pipe with the flanges confronting each other, with a gap therebetween, and with recesses in the flanges aligned. Refractory connecting members are disposed in the aligned recesses, the connecting members having a bridging section extending across the gap and an enlarged end section in each of the aligned recesses. Refractory mortar secures the connecting members in the recesses and fills the gap between the flanges.

15 Claims, 2 Drawing Sheets

REFRACTORY TILE SECTION FOR REHEATING FURNACES

FIELD OF THE INVENTION

The present invention relates to refractory tile sections and particularly to refractory tile sections used to insulate water-cooled metal pipes of a metallurgical apparatus such as a reheating furnace.

BACKGROUND OF THE INVENTION

Water cooled pipes are often used in metallurgical processing, such as in work support systems for furnaces where heavy metal bodies are heated to a hot working temperature, such as in pusher-type continuous slab reheating furnaces. In order to protect the pipes, an insulation, such as refractory tiles, is used to guard the water-cooled pipes from high temperature and oxidation and also to reduce heat loss from the furnace into the supporting structures.

In my earlier patent, U.S. Pat. No. 4,070,151, which issued Jan. 24, 1978, and the contents of which are incorporated by reference herein, a typical work support system for a continuous slab reheating furnace is described. In that patent, the insulation, in the form of refractory tiles, is tightly secured to water-cooled pipes by flanged hollow studs that are located radially with respect to the precast refractory tile sections, and the inner ends of the studs are electrically welded to the pipe surface. The precast refractory tile sections are of a length that renders them easily handled, with each section of a generally semicircular shape for application about the pipe.

In my earlier patent U.S. Pat. No. 4,330,266, which issued May 18, 1982, and the contents of which are incorporated by reference herein, an improvement over the tiles described in U.S. Pat. No. 4,070,151 is described, where two half-sections have interfitting parts which are interlocked and bolted about the pipe. In that patent, each of two sections of a tile has a metallic fastening device that is welded to the pipe and is embedded in the refractory, and when in place, such a system is fixed until the refractory tile body has disintegrated to a point where replacement is necessary.

In my earlier patent U.S. Pat. No. 4,424,027, which issued Jan. 3, 1984, and the contents of which are incorporated by reference herein, a further improvement in insulating tiles for water-cooled pipes is disclosed. In that patent, the insulating tile sections fit around the pipe, where the refractory tile bodies are formed about a metal channel section having a bottom, and spaced side walls with outwardly extending flanges along the top edge of the side walls. A radial hole is formed in the tile section concentric with an opening through the bottom of the metal channel, with the surface of the bottom of the channel adapted to contact the exterior of the metal pipe, such that a rivet-like weld may be used to fuse the pipe and metal channel section together and affix the refractory tile to the pipe.

While these earlier systems have been satisfactory and well accepted in the trade, they all contain metallic parts in the refractory insulation, which would best be eliminated due to the difference in the thermal expansion of the metal parts and the refractory material of the tile, and other factors.

It is an object of the present invention to provide a refractory tile section for encasement of a metal pipe that does not use any metal parts for securement of the refractory tile to the pipe.

SUMMARY OF THE INVENTION

A refractory tile section, for application to a pipe to insulate the pipe, has a pair of refractory tiles and refractory connecting members. The pair of refractory tiles each have a concave face that is complementary to the curvature of the pipe for which it is adapted to be used, and an outwardly extending flange at each of the arcuate ends of the refractory tile. Each flange has an end face and when the refractory tiles are placed about the pipe, an end face of a flange of one of the pair of refractory tiles will confront an opposed end face of the other refractory tile and leave a gap between the confronting faces.

A plurality of recesses are provided in each end face of the flanges, which recesses are of an enlarging cross-section in the direction away from the end face, and each recess of a flange is aligned with a recess in a confronting flange when the pair of refractory tiles are placed about the pipe. A connecting member formed from a refractory material is secured in the confronting recesses. The connecting member has a bridging section, which extends across the gap between the pair of refractory tiles, and a pair of end sections of increasing cross-section, with one of the end sections of the connector disposed in each of the aligned recesses of the flange of the refractory tiles. A refractory mortar secures the connecting members in the recesses.

DESCRIPTION OF THE DRAWINGS

The invention will be more fully understood by reference to the accompanying drawings, wherein.

DETAILED DESCRIPTION

The present invention provides an insulating system in the form of refractory tile sections that are assembled on metal pipes without the use of any metal fastening devices. The refractory tile sections are especially adapted for use on support systems for use in reheating furnaces.

Figure 1:
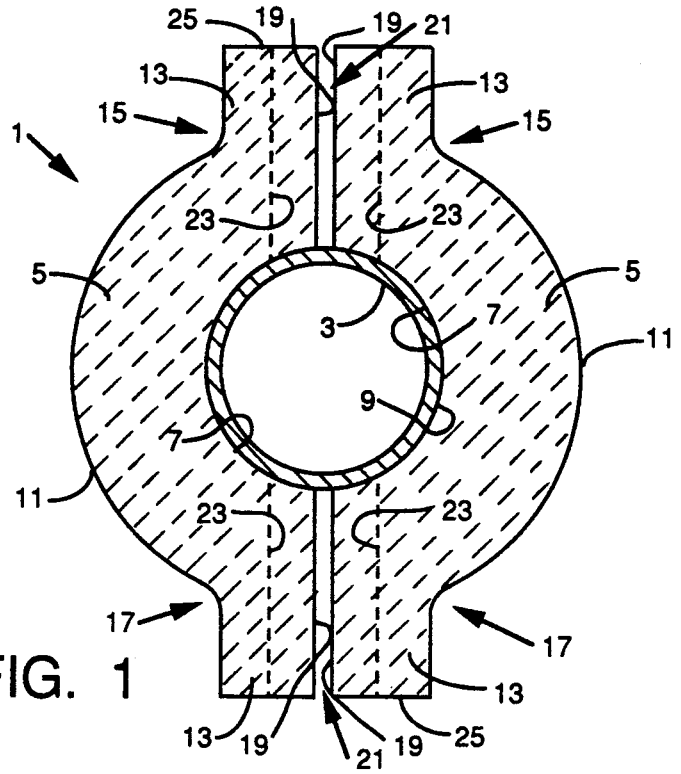
FIG. 1 is a cross-sectional view through a pipe with a pair of refractory tiles of the present invention assembled on the pipe prior to insertion of connection members.
Figure 2:
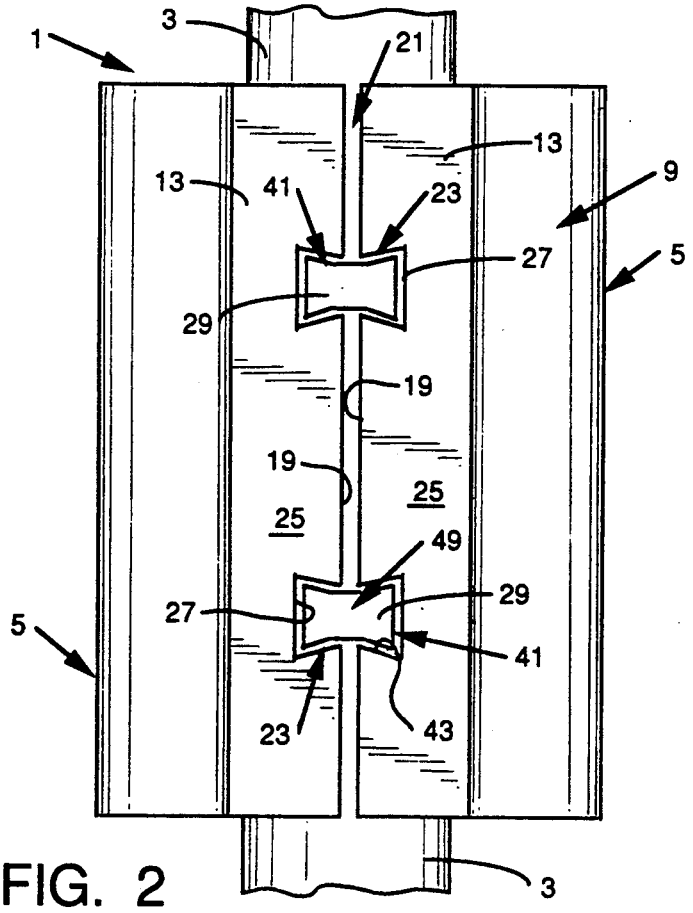
FIG. 2 is an elevational view of a pair of refractory tiles of the present invention with connectors inserted in the tile flange recesses to connect the tiles together.
Figure 3:
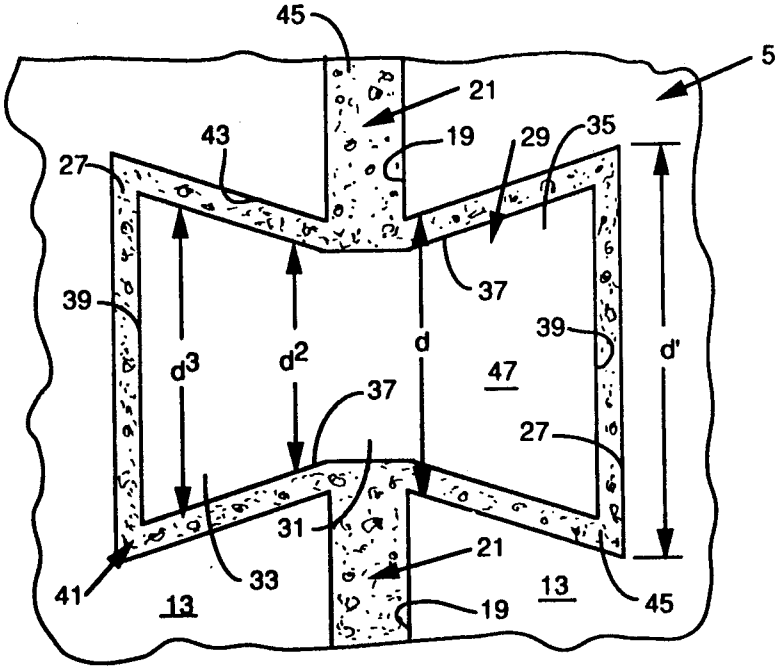
FIG. 3 is an enlarged view of on of the connectors shown in FIG. 2 connecting two refractory tiles together on a pipe after mortar has been placed in the gap between the flanges and between the connector and the inner wall of the recesses in the flange.

Referring now to FIGS. 1–3, a refractory tile section 1 is illustrated assembled on a metal pipe 3, which pipe 3 may be disposed in a vertical, horizontal or other direction. The refractory tile section 1 is formed from a pair of refractory tiles 5, each refractory tile 5 having a concave face or inner surface 7 which conforms to the curvature of outer surface 9 of the metal pipe 3 about which the refractory tile 5 is placed. Each refractory tile 5, which may have an arcuate outer surface 11, has a radially outwardly extending flange 13 at each of the arcuate ends 15 and 17, each flange 13 having an end face 19. The refractory tiles 5 are of a size such that, upon assembly about the pipe 3 with end faces 19 in opposed relationship, a small gap 21 is formed between confronting end faces 19 of the flanges 13.

Each of the refractory tiles 5 has a plurality of recesses 23 in the end face 19 of the flange 13, extending from the outer end 25 of the flange 13 to the inner surface 7 of the refractory tile 5. The recesses 23 are of an enlarging cross-section in the direction away from the end face 19, as best illustrated in FIG. 3, with the recess 23 at the face 19 of the flange 13 having a dimension d, while adjacent or at the base 27 of the recess, the recess 23 has a greater diameter d'. The recesses 23 are provided in the flanges 13 at a location such that recesses 23 of one flange 13 are aligned with recesses 23 in a confronting flange 13 when a pair of refractory tiles 5 are placed about the pipe 3.

Figure 4:
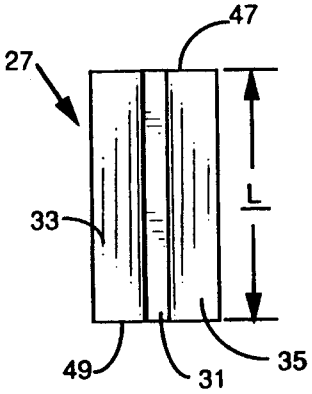
FIG. 4 is a plan view of the connector shown in FIG. 3.

In order to connect the pair of refractory tiles 5 together, when placed about a pipe 3, a connecting member 29 is provided, which connecting member 29 is composed of a refractory material, and which connecting member 29 is inserted into confronting recesses 23 and across the gap 21 between a pair of refractory tiles 5. A preferred connecting member 29, illustrated in FIGS. 2–4, has a bridging section 31 and a pair of end sections 33 and 35 that are integrally formed with the bridging section 31. The end sections 33 and 35 have an increasing cross-section as shown, with a dimension $d^2$ at location 37 adjacent the bridging section 31 and a larger diameter $d^3$ at the outer ends 39 of the connecting member 29. The outer dimensions of the connecting member 29 are of a size such as to leave a passageway 41 between the connecting member 29 and the base 27 forming the recess 23 in the flange 13.

As shown in FIG. 3, a preferred structure of the connecting member 29 is a "bow-tie" design, with a bridging member 31 and end sections 33 and 35. In such a construction, each end section 33 and 35 extends from the bridging section 31 in a cross-sectional shape of a trapezoid, or more specifically, each end section 33 and 35 is in the shape of a truncated pyramid.

The tile sections 1 are assembled about a metal pipe 3 by placing a pair of refractory tiles 5 in opposed and aligned position about the pipe 3 with flanges 13 of a first of a pair of refractory tile sections 5 confronting the flanges 13 of a second of the pair of refractory tile sections 5, and with the plurality of recesses 23 of the first refractory tile section 5 in alignment with the plurality of recesses 23 of the second refractory tile section 5. Such a positioning is shown in FIGS. 1 and 2. The refractory tiles are sized such that a small clearance exists between the outer end 9 of the metal pipe 3 and the inner surface 7 of the positioned refractory tiles 5, and the gap 21 is formed between the end faces 19 of confronting flanges 13 of the refractory tiles 5. A refractory mortar 45 is pressed into the recesses 23 and the area of the gap 21 adjacent the recesses 23. After placement of the refractory mortar 45, a connecting member 29 is inserted into each of the aligned pair of recesses 23 with the bridging member 31 extending across the gap 21 between the recesses 23. Insertion of the connecting member will force some of the refractory mortar 45 into the small clearance between the outer surface 9 of the metal pipe 3 and the inner surface 7 of the refractory tiles 5, with refractory mortar 45 also filling the passageway 41 between the connecting member 29 and the inner walls 43 and base 27 of each recess 23. The refractory mortar 45 forced into the small clearance between the outer surface 9 of the metal pipe 3 and the inner surface 7 of the refractory tiles 5 will act as a dampening means and reduce vibrations, so as to extend the life of the tile sections 1. Additional refractory mortar 45 is also placed in and fills the gap 21 between the flanges 13 along the length of the refractory tiles 5. The length L of the connecting member 29 (FIG. 4) is such that a inner end 47 of the refractory member 29 will abut the metal pipe 3 with some refractory mortar therebetween, while an outer end 49 will be flush with the outer end 25 of the flanges 13 of the pair of refractory tiles 5.

Figure 5:
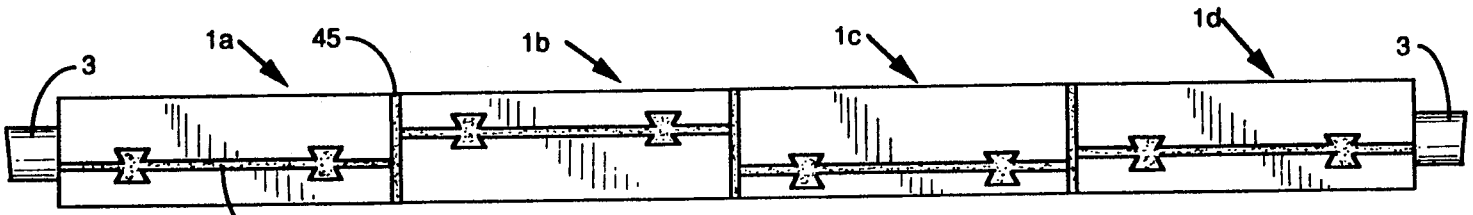
FIG. 5 is a schematic illustration of four refractory tile sections of the present invention applied about a pipe showing staggering of the gap between one pair of tile sections relative to the gap between abutting tile sections.

FIG. 5 illustrates schematically a series of refractory tile sections 1, designated 1*a*, 1*b*, 1*c* and 1*d*, assembled about a metal pipe 3. The refractory tile sections are in substantially abutting relationship, with refractory mortar 45 filling any spacing between adjacent refractory tile sections. In a preferred embodiment, as illustrated, the refractory tile sections 1*a*, 1*b*, 1*c* and 1*d* are positioned on the metal pipe 3 such that the gap 21 of one refractory tile section, e.g., 1*a*, is offset from the gap 21 of an abutting tile section 1*b*.

Figure 6:
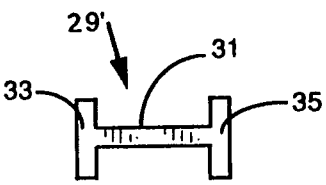
FIG. 6 is a plan view of another embodiment of a refractory connector for us with the refractory tile sections of the present invention.

Another embodiment of the connecting member is illustrated in FIG. 6 which shows a "dumbbell"-shaped connector 29' having a bridging member 31 and two end sections 33 and 35 of enlarging cross-section.

As an example of the present refractory tile sections 1, but without any limitation intended as to specific dimensions that may be used for the same, for use with a 4" outer diameter steel pipe, refractory tiles 5 of the length of 12" could be used. The refractory tiles have a wall thickness of 1⅞" with flanges 13 extending outwardly 1½" from wall surface. The width of the flange 13 would also be about 1½" and when placed about the metal pipe 3, a ¼" gap 21 would be left between confronting end faces 19 of the flanges 13, While about 1/16" clearance would be provided between the outer surface 9 of the metal pipe 3 and the inner surface 7 of the refractory tiles 5 when a pair of tiles are assembled on the pipe. A pair of spaced recesses 23 are provided in each flange 13 extending from the outer end 25 of the refractory tile 5 to the inner surface 7 thereof. Each recess 23 is ¾" deep, from the end face 19 of the flange 13 to the base 27 of the recess 23, with the width of the recess being about 1" at the end face 19 and enlarging to a width of about 1½" at the base 27. The connecting member 29, having a "bow-tie" shape would have a bridging section 31 that is ¾" wide, and end sections 33 and 35, enlarging to a width of about 1 1/16" at the ends 39. The total length of the connecting member would be about 1¾". With such dimensions, the passageway 41 of about ⅛" is provided around the connecting member 29 between the connecting member 29 and the inner walls 43 and base 27 of the recess 23.

The present invention thus provides refractory tile sections that ma be assembled on pipes without the need for any metal fastening devices and problems associated with such metal fastening means.

What is claimed is:

1. A refractory tile section for application to a pipe to insulate the pipe from a hot environment comprising:

a pair of refractory tiles, each having a concave face conforming to the curvature of the metal pipe about which the tile is to be placed and having a radially outwardly extending flange at each of the arcuate ends thereof, each said flange having an end face, said pair of tiles when placed about said pipe with said end faces in opposed relationship providing a gap between confronting said flanges;

a plurality of recesses of an enlarging cross-section in the end face of each of said flanges, with a said recess in each flange aligned with a said recess in a confronting flange when said pair of refractory tiles are placed about said pipe; and a connecting member formed from refractory material secured in aligned said recesses having a bridging section which extends across said gap and a pair of end sections of increasing cross-section, one said end section disposed in each of said aligned recesses.

2. A refractory tile section as defined in claim 1, wherein a refractory mortar is provided in said gap to seal the gap between confronting said flanges.

3. A refractory tile section as defined in claim 1, wherein said end sections of said connecting member are of size less than the enlarging cross-section of said recesses so as to leave a passageway between the outer surface of said end sections and the inner surface of said tile about said recesses, and a refractory mortar is provided in said passageway.

4. A refractory tile section as defined in claim 1, wherein a said end section has a cross-sectional of a trapezoidal shape.

5. A refractory tile section as defined in claim 4, wherein said end section has a shape of a truncated pyramid.

6. A refractory tile section applied to a pipe to insulate the pipe from a hot environment comprising:

a pair of refractory tiles, each having a concave face conforming to the curvature of the metal pipe about which the tile is to be placed and having a radially outwardly extending flange at each of the arcuate ends thereof, each said flange having an end face, said pair of tiles when placed about said pipe with said end faces in opposed relationship providing a gap between confronting said flanges;

a plurality of recesses of an enlarging cross-section in the end face of each of said flanges, with a said recess in each flange aligned with a said recess in a confronting flange when said pair of refractory tiles are placed about said pipe; and a connecting member formed from refractory material secured in aligned said recesses having a bridging section which extends across said gap and a pair of end sections of increasing cross-section, one said end section disposed in each of said aligned recesses; and a refractory mortar disposed in said gap to seal said gap between confronting said flanges.

7. A refractory tile section applied to a pipe as defined in claim 6, wherein said end sections of said connecting member are of a size less than the enlarging cross-section of said recesses so as to leave a passageway between the outer surface of said end sections and the inner surface of said tile about said recesses, and a refractory mortar is provided in said passageway.

8. A refractory tile section applied to a pipe as defined in claim 7, wherein said refractory tile section comprises a first refractory tile section, and a second said refractory tile section is applied to said pipe in an abutting relationship, and a refractory mortar is provided between said first refractory tile section and said second abutting refractory tile section.

9. A refractory tile section applied to a pipe as defined in claim 8, wherein the gap of said first refractory tile section is radially offset from the gap of said second refractory tile section.

10. A refractory tile section applied to a pipe as defined in claim 6, wherein said pipe comprises a metal pipe of a support structure of a slab reheating furnace.

11. A method of insulating a pipe from a hot environment comprising:

(a) providing a pair of refractory tiles, each having a concave face conforming to the curvature of the metal pipe about which the tile is to be placed and having a radially outwardly extending flange at each of the arcuate ends thereof, each said flange having an end face, said pair of tiles when placed about said pipe with said end faces in opposed relationship providing a gap between confronting said flanges; the end face of each of said flanges having a plurality of recesses of an enlarging cross-section therein, with a said recess in each flange aligned with a said recess in a confronting flange when said pair of refractory tiles are placed about said pipe;

(b) assembling said pair of refractory tiles about said pipe with said flanges confronting each other and said recesses of one of said pair of refractory tiles in alignment with the other of said pair of refractor tiles;

(c) pressing a refractory mortar into said aligned recesses;

(d) inserting a connecting member formed from refractory material in said aligned recesses, said connecting member having a bridging section which extends across said gap and a pair of end sections of increasing cross-section, one said section disposed in each of said aligned recesses, to secure said pair of refractory tiles together.

12. The method of insulating a pipe from a hot environment as defined in claim 11, wherein refractory mortar is pressed into said gap between said end faces of said confronting flanges.

13. The method of insulating a pipe from a hot environment as defined in claim 11, wherein said refractory tiles are assembled about said pipe with a clearance between the outer end of said pipe and the concave faces of said refractory tiles, and wherein a portion of the refractory mortar pressed into said recesses is distributed into said clearance upon insertion of said connecting member.

14. The method of insulating a pipe from a hot environment as defined in claim 11, wherein a plurality of said refractory tile sections are provided about said pipe in abutting relationship and refractory mortar is pressed between said abutting refractor tile sections.

15. The method of insulating a pipe from a hot environment as defined in claim 14, wherein said abutting refractory tile sections are provided with said gaps of abutting refractory tile sections offset from each other.

* * * * *